United States Patent [19]

Kishida et al.

[11] 4,093,243

[45] June 6, 1978

[54] RUBBING CONTACT SEAL MEMBER WITH LOW WEAR COATING AND METAL-CONTAINING UNDERCOAT

[75] Inventors: Katsuhiro Kishida; Akira Oyamada, both of Yokohama, Japan

[73] Assignee: Nissan Motor Company Limited, Yokohama, Japan

[21] Appl. No.: 713,265

[22] Filed: Aug. 10, 1976

[30] Foreign Application Priority Data

Aug. 29, 1975 Japan ..... 50-103902

[51] Int. Cl.[2] ..... F28D 19/00; F16J 15/34

[52] U.S. Cl. ..... 277/96.2; 165/9

[58] Field of Search ..... 277/96, 96.1, 96.2; 165/9

[56] References Cited

U.S. PATENT DOCUMENTS 3,669,016 12/1962 Dega ..... 277/96

3,903,959 9/1975 Fushimi et al. ..... 165/9

*Primary Examiner*—Robert I. Smith

[57] ABSTRACT

A member including a metal substrate, a low wear coating formed by flame spraying a mixture of a wear resistant metal oxide such as nickel oxide and a solid lubricating material such as calcium fluoride to serve as a high temperature rubbing contact seal layer and at least one undercoat layer formed by flame spraying between the substrate and the surface layer, characterized by the presence of a metal in at least one of the undercoat layers mixed with a commonly employed fundamental material, which is the wear resistant metal oxide optionally with the addition of the solid lubricating material, in order to lessen the difference in thermal expansion coefficient between the individual undercoat layer and the surface layer.

12 Claims, 3 Drawing Figures

RUBBING CONTACT SEAL MEMBER WITH LOW WEAR COATING AND METAL-CONTAINING UNDERCOAT

This invention relates to a low wear member which is adapted for providing a rubbing contact face and consists of a metal substrate and a high temperature low wear coating formed on the substrate by a flame spraying technique. This member is particularly useful in a gas turbine.

Gas turbine engines which use rotary regenerators usually employ rubbing contact seals in association with the regenerators. A typical seal member for this use comprises a metal substrate and a coating applied to the substrate to provide a surface layer having a low coefficient of friction and a low wear property when used with a regenerator material, which is usually a ceramic material, at high temperatures. A typical example of the substrate material is an austenitic stainless steel such as an AISI 304 stainless steel (18Cr-8Ni). Usually, a bonding layer of, for example, nickel aluminide is formed on a surface of the substrate as a preparation for the application of the low wear coating. The coating consists of, for example, a first intermediate or undercoat layer of nickel oxide (NiO) formed on the bonding layer, a second undercoat layer consisting of 90% nickel oxide as a matrix material and 10% calcium fluoride as a glazing or lubricating material, and a surface layer which is formed on the second undercoat layer and consists of 80% nickel oxide and 20% calcium fluoride. These three layers of the coating as well as the bonding layer are applied individually by a flame spraying technique. The surface layer is usually about 0.5 mm thick while the bonding layer and the undercoat layers are individually about 0.1 mm thick.

A seal member of this type has the disadvantage that the surface layer, for example, is liable to separate from the second undercoat layer when used at temperatures above about 600°C. The occurrence of such a separation can be prevented to a certain extent by limiting the thickness of the surface layer and/or decreasing the amount of calcium fluoride in the surface layer and/or the second undercoat layer. A countermeasure of this type, however, is unprofitable for the service life of the seal member.

The separation is fundamentally attributable to the fact that the materials of the coated layers have respectively differently lower coefficients of thermal expansion than the substrate metal. In the above example, the observed values of the linear coefficient of thermal expansion $\beta$ ($\times 10^{-6}$/°C, as a mean value over the temperature range between room temperature and 800°C) of the individual layer materials were as follows: 304 stainless steel . . . 17.7, nickel aluminide . . . 14.4, NiO . . . 11.0, 90/10 NiO—$CaF_2$ . . . 12.0, and 80/20 NiO—$CaF_2$ . . . 14.5. The expansion coefficients of the two undercoat layers are significantly lower than either the expansion coefficient of the surface layer or that of the substrate, so that a greatest shear stress develops in either the first or second undercoat layer when the seal member is heated. The shear stress chances to exceed the bonding force of the second undercoat layer to the surface layer, resulting in the separation at or in the vicinity of the interface between the two layers, either when the seal member is alternately subjected to a rapid and considerable heating and a rapid cooling or when the seal member is simultaneously heated in a portion and cooled in the remaining portion. The first undercoat layer does not easily crack or exhibit separation due to strong cohesive force of the bonding layer with respect to not only the substrate but also the first undercoat layer.

It is an object of the present invention to provide a low wear member in the form of a metal substrate with a low wear coating adapted for providing a rubbing contact face, the coating of which member has a greatly enhanced resistance to breakage by the exposure to high temperature atmospheres above about 600°C, or even above about 700°C, and/or repeated temperature change even when the coating has a comparatively large thickness and accordingly is particularly useful as a rubbing contact seal member on a rotary regenerator of a gas turbine.

A low wear member according to the invention includes a metal substrate which may be coated with a bonding layer of an alloy, at least one undercoat layer which is formed by a flame spraying technique on the metal substrate and individually is made fundamentally of a wear resistant metal oxide optionally with the addition of a solid lubricating material, and a surface layer which is formed by a flame spraying technique on the outmost undercoat layer to provide a rubbing contact face and is made essentially of the metal oxide and the solid lubricating material. In these respects, the low wear member is of a known construction. The low wear member is characterized in that at least one of the undercoat layers additionally contain a metal which has such a coefficient of thermal expansion that the metal-containing undercoat layers individually have a thermal expansion coefficient not significantly different from that of the surface layer. Of course it is preferable to select the metal and determine the amount of the metal in the individual undercoat layer also taking into consideration the difference in thermal expansion coefficient between the undercoat layer and the substrate.

Preferably, the metal is either copper or nickel when the low wear member is for use at a temperature above 700°C, but aluminum may alternatively be used when the low wear member is not required to be operable at temperatures above about 600°C. Mixtures of these three metals also are useful.

The respective materials of the surface layer, substrate and bonding layer as well as the fundamental materials of the undercoat layers can be selected on the same basis as in conventional rubbing seal members for rotary regenerators. Examples of useful wear resistant metal oxides are NiO and CoO, including their mixtures. The solid lubricating material is selected from fluorides of Group IIa metals such as $MgF_2$, $CaF_2$ and $BaF_2$, but may alternatively be selected from certain phosphates such as $Mg_2P_2O_7$ and $Ca_2P_2O_7$, borates typified by $CaB_4O_7$ and other compounds exemplified by PbO. Nickel aluminide is a preferred material of the bonding layer. The metal substrate may be of steel, aluminum or magnesium, but is preferably an austenitic stainless steel such as an AISI 304 stainless steel. Since an austenitic stainless steel is a usually employed substrate material but has a considerably larger coefficient of thermal expansion than the above described metal oxide, the invention is of great value in practical applications.

The invention will fully be understood from the following detailed description of preferred embodiments with reference to the accompanying drawing, wherein.

Figure 1:
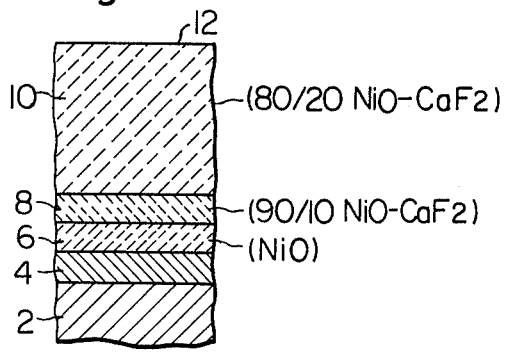
Fig. 1 PRIOR ART
FIG. 1 is an enlarged cross-sectional view of a conventional rubbing contact seal member.

FIG. 1 shows the construction of the exemplary conventional seal member outlined hereinbefore. This seal member was used in Examples presented hereinafter as a standard of comparison. The substrate 2 was of a 304 stanless steel, and a bonding layer 4 was formed by flame spraying 96%Ni—4%Al nickel aluminide onto the surface of the substrate 2 to a thickness of 0.1 mm. A first undercoat layer 6 was formed by flame spraying powdered NiO onto the bonding layer 4 to a thickness of 0.1 mm. The expansion coefficient $\beta$ of NiO was $11.0 \times 10^{-6}/°C$. A second undercoat layer 8 also was formed by flame spraying and was 0.1 mm thick. The material of this layer 8 was a powder mixture of 90 Wt% NiO and 10 Wt% $CaF_2$. The expansion coefficient $\beta$ of this material was $12.0 \times 10^{-6}/°C$. The surface layer 10, which provides a rubbing contact face 12, was formed by flame spraying a powder mixture of 80 Wt% NiO and 20 Wt& $CaF_2$. As the result of the use of an increased amount of $CaF_2$ (compared with the undercoat layer 8) for enhancing the lubricating property, the material of the surface layer 10 had a $\beta$ value of $14.5 \times 10^{-6}/°C$.

As mentioned hereinbefore, both the first and second undercoat layers 6 and 8 are significantly different (lower) in thermal expansion coefficient not only from the substrate 2 but also from the surface layer 10. In the present invention, a metal is added to at least one of the these undercoat layers 6 and 8 so that the thermal expansion coefficients of the undercoat layer 6 and/or 8 may be raised and become at least very close to the expansion coefficient of the surface layer 10. Accordingly, the metal to be added to the undercoat layer 6 and/or 8 must have a higher thermal expansion coefficient than NiO and 90/10 NiO—$CaF_2$ mixture. Copper, nickel and aluminum are preferred examples of metals which meet this requirement and are available at reasonable cost. The liner thermal expansion coefficients $\beta$ of nickel and copper (mean values over the temperature range between room temperature and 800°C) are $16.6 \times 10^{-6}/°C$ and $19.5 \times 10^{-6}/°C$, respectively. A mean value of $\beta$ of aluminum over the range between room temperature and 600°C is $24.6 \times 10^{-6}/°C$.

By adding these metals, either singularly or in the form of a mixture, to the second undercoat layer 8 and/or the first undercoat layer 6 in an appropriate quantity, it is possible to greatly lessen the difference in thermal expansion coefficient between the surface layer 10 and the resulting undercoat layer. Consequently, the undercoat layer is remarkably relieved of a shear stress upon heating of the seal member. Besides, the metal contained in the undercoat layer can further relieve the shear stress by transforming part of the lessened shear stress to plastic deformation of the individual metal particles. Thus a low wear member or seal member according to the invention features a remarkably enhanced resistance to high temperatures and thermal shocks and accordingly an excellent durability.

It will be understood that a metal added to each undercoat layer must uniformly be dispersed in the fundamental material of the layer. The metal, therefore, is thoroughly mixed with the fundamental material of each undercoat layer prior to the application of the material onto the substrate (or the bonding layer) or a precedingly formed undercoat layer. When a seal member has two or more undercoat layers as in the case of FIG. 1, a metal is preferably added to all of the undercoat layers either in the same amount or in variously different amounts for the respective layers.

EXAMPLE 1

Figure 2:
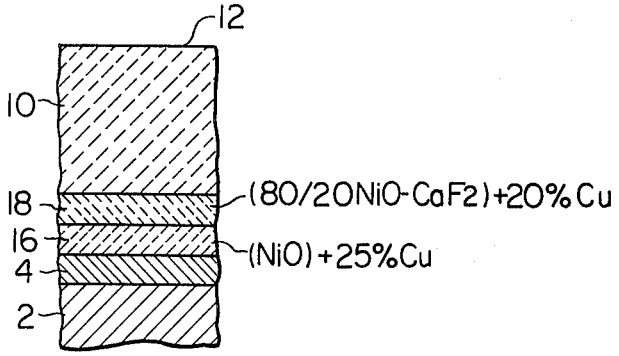
FIG. 2 is an enlarged cross-sectional view of rubbing contact seal member as a preferred embodiment of the invention with fundamentally the same construction as the seal member of FIG. 1.

A rubbing contact seal member produced in this example had a construction as shown in FIG. 2, i.e. fundamentally the same construction as the prior art seal member of FIG. 1 except for the presence of copper in two undercoat layers 16 and 18.

The bonding layer 4 was formed by flame spraying the powdered 96/4 nickel aluminide onto the 304 stainless steel substrate 2 to a thickness of 0.1 mm. The material of the first undercoat layer 16 was a powder mixture of 100 parts by weight of NiO and 25 parts by weight of Cu. The linear thermal expansion coefficient $\beta$ of this material was $13.5 \times 10^{-6}/°C$. This material was applied onto the bonding layer 4 by flame spraying to a thickness of 0.1 mm. The second undercoat layer 18 also was 0.1 mm thick and formed by flame spraying, but the material of this layer 18 was a powder mixture of 100 parts by weight of 90/10 NiO— $CaF_2$ and 20 parts by weight of Cu ($\beta = 13.55 \times 10^{-6}/°C$). The surface layer 10 was of 80/20 NiO-$CaF_2$ ($\beta = 14.5 \times 10^{-6}/°C$) and 0.5 mm thick as in the prior art seal member of FIG. 1.

The thus produced seal member of FIG. 2 was subjected to a heat shock test which was a repetition of a cycle of a rapid heating to 800°C, maintenance at this temperature and a rapid cooling to room temperature, one cycle being completed in 5 hr. This heat shock cycle was successively repeated ten times, but the seal member of this example neither cracked nor exhibited any separation between the second undercoat layer 18 and the adjacent layers 10 and 16.

The prior art seal member of FIG. 1 also was subjected to the same test. In this case, a significant separation occurred between the second undercoat layer 8 and the surface layer 10 upon completion of only one heat shock cycle, so that the seal member became unserviceable as a seal element for regenerators in gas turbines.

Example 1 was repeated except that the surface layer 10 was thickened up to 0.8 mm. The resultant seal members exhibited no layer separation when subjected to 10 cycles of the heating to 800°C and cooling to room temperature. An increased thickness of the surface layer 10 affords the seal member a longer service life. The large extent of thickness increase, 0.5 to 0.8 mm, was realized without losing toughness of the seal member on account of a remarkably lessened difference in thermal expansion coefficient between the second undercoat layer 18 (as well as the first undercoat layer 16 in this example) from the surface layer 10.

The proportion of Cu to the fundamental material (e.g. NiO or NiO—$CaF_2$) of the undercoat layer 18 (and/or 16) can be varied over a fairly wide range, but the effect of the addition of Cu is not celarly appreciable when the proportion of Cu is less than 10 Wt%. On the other hand, it is undesirable that the proportion of Cu exceeds 50 Wt% because of unfavorable effects on the wear resistance and bonding property of the undercoat layers 18 and 16.

EXAMPLE 2

This example also relates to a seal member fundamentally constructed as shown in FIG. 1 or FIG. 2. The 304 stainless steel substrate 2 and the 0.1 mm thick nickel aluminide bonding layer 4 were identical with the ones in Example 1. A 0.1 mm thick first undercoat layer 16 was formed on the bonding layer 4 by flame spraying a powder mixture of 100 parts by weight of NiO and 10 parts by weight of Al ($\beta$ of this mixture was $12.4 \times 10^{-6}/°C$). Then a 0.1 mm thick second undercoat layer 18 was formed on the first undercoat layer 16 by flame spraying a powder mixture of 100 parts by weight of 90/10 NiO—$CaF_2$ and 10 parts by weight of Al ($\beta = 13.3 \times 10^{-6}/°C$). The 0.5 mm thick surface layer 10 of 80/20 NiO—$CaF_2$ was formed according to Example 1.

When this seal member was subjected to the above described heat shock test, the seal member cracked upon completion of six cycles of the heating and cooling. The cracking originated from melting of Al in the seal member (the heating temperature, 800°C, was above the melting point of Al, about 660°C). In confirmation, the proportion of Al both to NiO and to 90/10 NiO—$CaF_2$ was increased to 30 Wt%, and the resultant seal member exhibited separation between the surface layer 10 and the second undercoat layer 18 when only once heated to 800°C. In this case, liquefied aluminum films were present in the heated seal member. However, the addition of Al in 30 Wt% to the undercoat layers 16 and 18 resulted in the occurrence of neither cracks nor separation in the seal member when the ten-cycle heat shock test was carried out by lowering the heating temperature to 600°C. Under this test condition, it was possible to increase the thickness of the surface layer 10 (with the addition of 30% Al to undercoat layers) up to 1.2 mm without failing in passing the test.

Thus, the addition of Al is effective when the operative temperature of the product is below the melting point of Al. The proportion of Al to the fundamental material of any one of the undercoat layers is preferably in the range from 10 to 30 Wt%. The effect of the addition of Al on the resistance to heat shocks is inappreciable when the proportion of Al is less than 10%. The addition of more than 30% of Al is unfavorable to the wear resistance and maximum operative temperature of the product.

EXAMPLE 3

This example was similar to Example 1 except that the undercoat layers 16 and 18 were formed with the addition of the following amounts of Ni in place of Cu. The material of the first undercoat layer 16 was a powder mixture of 100 parts by weight of NiO and 35 parts by weight of Ni ($\beta$ of this mixture was $13.0 \times 10^{-6}/°C$), and the second undercoat layer 18 was made from a powder mixture of 100 parts by weight of 90/10 NiO—$CaF_2$ and 30 parts by weight of Ni ($\beta = 13.4 \times 10^{-6}/°C$). This seal member passed the ten-cycle heat shock test (800°C) without exhibiting any breakage.

As a modification the proportion of Ni to NiO for the first undercoat layer 16 was increased to 60 Wt% ($\beta$ of the resulting mixture was $14.3 \times 10^{-6}/°C$), and the proportion of Ni to 90/10 NiO—$CaF_2$ for the second undercoat layer 18 was also increased to 60 Wt% ($\beta$of the resulting mixture was $14.7 \times 10-6/°C$). Besides, the surface layer 10 was thickened to 0.8 mm. The thus modified seal member also passed the ten-cycle heat shock test (800°C), exhibiting no breakage.

Nickel as an additive according to the invention can be used in a relatively large amount compared with copper or aluminum when the wear resistant metal oxide in the undercoat layers is NiO. However, the proportion of Ni to either NiO or a mixture of NiO and a solid lubricating material should be limited to 70 Wt% at the maximum to produce an undercoat layer of desirable physical properties and allow the use of the lubricating material in an adequate amount.

EXAMPLE 4

Figure 3:
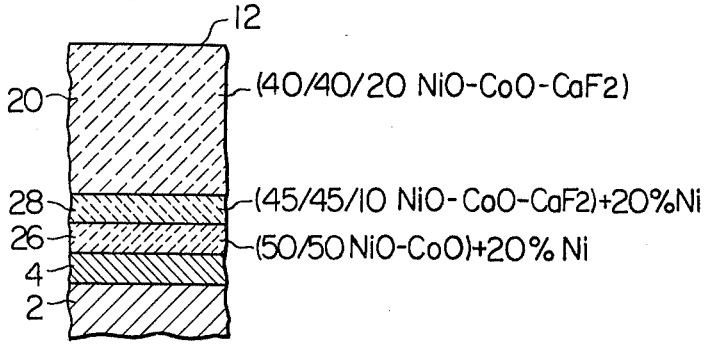
FIG. 3 is a similar view of a different seal member as a variation in the materials of the seal member of FIG. 2.

FIG. 3 shows the construction of a seal member according to this example. The substrate 2 and the 0.1 mm thick nickel aluminide bonding layer 4 were the same as in the foregoing examples. Two undercoat layers 26 and 28, each 0.1 mm in thickness, and a 0.5 mm thick surface layer 20 were individually formed by flame spraying. The material of the first undercoat layer 26 was a powder mixture of 100 parts by weight of a 50/50 NiO—CoO mixture and 20 parts by weight of Ni ($\beta$ was $13.8 \times 10^{-6}/°C$ for this material). The material of the second undercoat layer 28 was a powder mixture of 100 parts by weight of a 45/45/10 mixture of NiO—CoO—$CaF_2$ and 20 parts by weight of Ni ($\beta = 14.0 \times 10^{-6}/°C$). The surface layer 20 was made from a ternary material consisting of 40% NiO, 40% CoO and 20% $CaF_2$.

This seal member passed the above described ten-cycle heat shock test without exhibiting any separation of the individual layers from adjacent layers.

EXAMPLE 5

Examples 1-3 were respectively repeated except that NiO was replaced by the same amount of CoO for both the undercoat layers 16 and 18 and the surface layer 10.

The change of NiO to CoO brought about substantially no difference in the results of the respective heat shock tests according to Examples 1–3.

What is claimed is:

1. In a low wear member which is adapted for rubbing contact with another member and is useful as a high temperature rubbing contact seal member on a rotary regenerator of a gas turbine, the low wear member including a metal substrate, at least one undercoat layer formed on a surface of said substrate, and a surface layer coated on an outmost one of said at least one undercoat layer, the material of said surface layer consisting essentially of a major amount of a refractory and wear resistant ingredient selected from the group consisting of CoO, NiO and mixtures thereof and a minor amount of a solid lubricating ingredient, the material of said at least one undercoat layer being said refractory and wear resistant ingredient optionally and individually with the addition of a minor amount of said solid lubricating ingredient, said at least one undercoat layer and said surface layer being formed individually by flame spraying, the improvement comprising at least one of said at least one undercoat layers additionally containing a metal, at least one member of which is selected from the group consisting of Cu, Ni or Al, the coefficient of thermal expansion of said metal and the amount of said metal being such that each of the metal-containing undercoat layers is less different from said surface layer in thermal expansion coefficient than an undercoat layer without said metal from said each of the metal-containing undercoat layers.

2. The improvement as claimed in claim 1, wherein said solid lubricating ingredient being selected from the group consisting of $MgF_2$, $CaF_2$, $Mg_2P_2O_7$, $Ca_2p_2O_7$, $CaB_4O_7$ and PbO.

3. The improvement as claimed in claim 2, wherein said metal is Cu, the amount of said Cu in each of the metal-containing undercoat layers is 10 to 50 Wt% of the total of the remaining ingredients of the same undercoat layer.

4. The improvement as claimed in claim 2, wherein said metal is Ni, the amount of said Ni in each of the metal-containing undercoat layers is 10 to 70 Wt% of the total of the remaining ingredients of the same undercoat layer.

5. The improvement as claimed in claim 2, wherein said metal is Al, the amount of said Al in each of the metal-containing undercoat layers is 10 to 30 Wt% of the total of the remaining ingredients of the same undercoat layer.

6. The improvement as claimed in claim 2, wherein said at least one undercoat layer consists of an inner undercoat layer consisting essentially of said refractory and wear resistant ingredient and said metal, and an outer undercoat layer consisting essentially of said refractory and wear resistant ingredient, said solid lubricating ingredient and said metal.

7. The improvement as claimed in claim 6, wherein said metal substrate has a bonding layer of an alloy formed between and in contact with said surface of said substrate and said inner undercoat layer.

8. The improvement as claimed in claim 7, wherein said metal substrate is of an austenitic stainless steel, said bonding layer being of nickel aluminide.

9. A high temperature rubbing contact seal member comprising:

a substrate of an austenitic stainless steel;

a bonding layer of nickel aluminide coated on a surface of said substrate;

an inner undercoat layer which is coated on said bonding layer and consists essentially of a wear resistant metal oxide selected from the group consisting of NiO, CoO and a mixture of NiO and CoO, and a metal selected from the group consisting of Cu, Ni and Al including their mixtures; an outer undercoat layer which is coated on said inner undercoat layer and consists essentially of said metal and a mixture of a major amount of said wear resistant metal oxide and a minor amount of $CaF_2$; and a surface layer which is coated on said outer undercoat layer and consists essentially of a major amount of said metal oxide and a minor amount of $CaF_2$; said inner and outer undercoat layers and surface layer being formed individually by flame spraying, the amount of said metal in each of said inner and outer undercoat layers being such that each of said inner and outer undercoat layers is less different from said surface layer in thermal expansion coefficient than an imaginary undercoat layer corresponding to the result of the exclusion of said metal from each of said inner and outer undercoat layers.

10. A seal member as claimed in claim 9, wherein said metal is Cu, said amount of Cu in said inner undercoat layer being from 10 to 50 Wt% of said metal oxide, said amount of Cu in said outer undercoat layer being 10 to 50 Wt% of said mixture of said metal oxide and $CaF_2$.

11. A seal member as claimed in claim 9, wherein said metal is Ni, said amount of Ni in said inner undercoat layer being 10 to 70 Wt% of said metal oxide, said amount of Ni in said outer undercoat layer being 10 to 70 Wt% of said mixture.

12. A seal member as claimed in claim 9, wherein said metal is Al, said amount of Al in said inner undercoat layer being 10 to 30 Wt% of said metal oxide, said amount of Al in said outer undercoat layer being 10 to 30 Wt% of said mixture.

* * * * *